United States Patent [19]

Amici et al.

[11] Patent Number: 4,608,025

[45] Date of Patent: Aug. 26, 1986

[54] GLOVE PUPPET FIGURE ASSEMBLY WITH ARTICULATED HEAD COMPONENTS

[75] Inventors: Francis R. Amici, Northford; Hans S. Berger, Plainville; Domenic G. Mercurio, Elmwood; John P. McNett, Farmington; Pietro Piazza, Prospect, all of Conn.

[73] Assignee: Coleco Industries, Inc., West Hartford, Conn.

[21] Appl. No.: 700,502

[22] Filed: Feb. 11, 1985

[51] Int. Cl.[4] ..... A63H 3/28; A63H 3/14

[52] U.S. Cl. ..... 446/298; 446/329

[58] Field of Search ..... 446/327, 328, 329, 330, 446/337, 338, 339, 352, 353, 359, 304, 313, 298, 303, 297, 35

[56] References Cited

U.S. PATENT DOCUMENTS

| | | | |
|---|---|---|---|
| 683,857 | 10/1901 | Kilpatrick . | |
| 928,744 | 7/1909 | Fisher . | |
| 1,417,860 | 5/1922 | Reich . | |
| 1,432,628 | 10/1922 | Slocum . | |
| 1,518,576 | 12/1924 | Edwards . | |
| 1,782,477 | 11/1930 | Price . | |
| 1,865,305 | 6/1932 | Dallas . | |
| 2,036,328 | 7/1936 | Furey . | |
| 2,158,860 | 5/1939 | Hyde . | |
| 2,241,576 | 5/1941 | Barton . | |
| 2,302,349 | 11/1942 | Renshaw . | |
| 2,546,209 | 3/1951 | Baum | 446/327 |
| 2,614,365 | 10/1952 | Musselwhite et al. . | |
| 2,637,939 | 5/1953 | Polk . | |
| 2,725,670 | 10/1955 | Hodes . | |
| 2,756,448 | 7/1956 | Werbe . | |
| 2,795,896 | 6/1957 | Snyder | 446/329 |
| 3,153,871 | 10/1964 | Semba . | |
| 3,358,400 | 12/1967 | Katz et al. . | |
| 3,577,670 | 5/1971 | Gutierrez . | |
| 3,698,127 | 10/1972 | Harp . | |
| 3,828,469 | 8/1974 | Giroud . | |
| 3,918,180 | 11/1975 | Chamberlin . | |
| 3,942,283 | 3/1976 | Rushton . | |
| 4,056,896 | 11/1977 | Karasawa | 446/315 X |
| 4,155,195 | 5/1979 | Leigh-Hunt | 446/35 |
| 4,207,704 | 6/1980 | Akiyama . | |
| 4,244,138 | 1/1981 | Holahan et al. . | |
| 4,304,065 | 12/1981 | Baiera . | |
| 4,307,533 | 12/1981 | Sims et al. . | |
| 4,324,065 | 4/1982 | Cooper . | |

FOREIGN PATENT DOCUMENTS

| | | | |
|---|---|---|---|
| 337132 | 5/1921 | Fed. Rep. of Germany | 446/327 |
| 414519 | 5/1925 | Fed. Rep. of Germany | 446/327 |

*Primary Examiner*—Mickey Yu

[57] ABSTRACT

A hand puppet figure has head components which can be moved, by manipulation of the operator's finger, relative to a body which is held substantially immobile on the operator's hand. The puppet figure may have wings capable of simulating flapping movement, while producing an audible sound, and the glove employed is both functional and contributes to aesthetic appeal.

16 Claims, 10 Drawing Figures

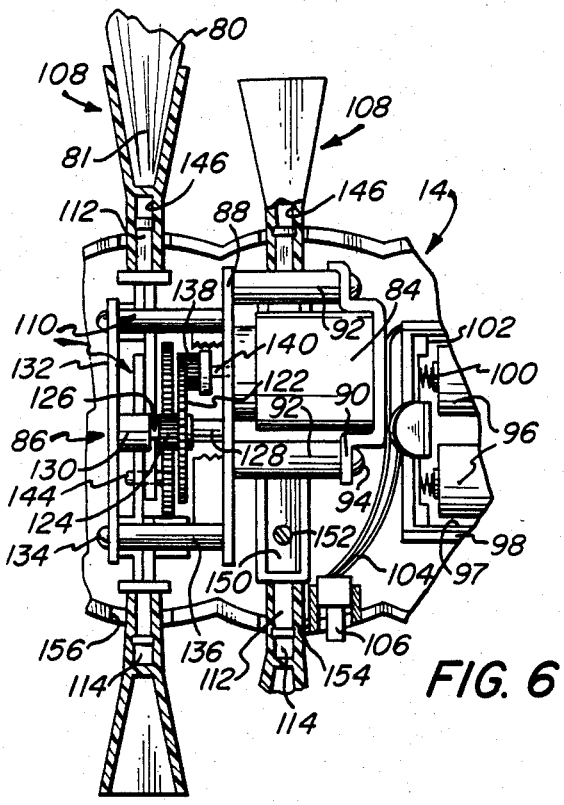
FIG. 6
FIG. 9
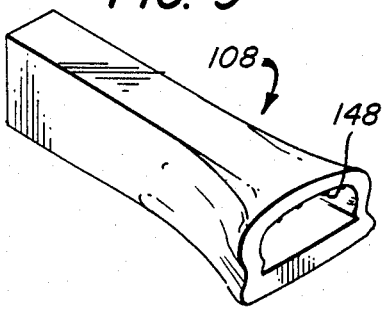
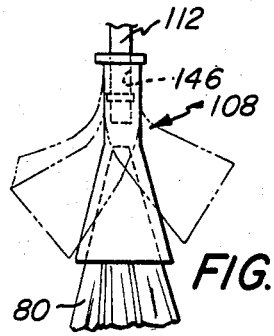
FIG. 10
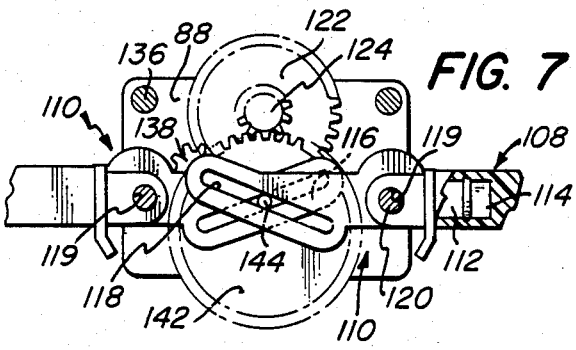
FIG. 7
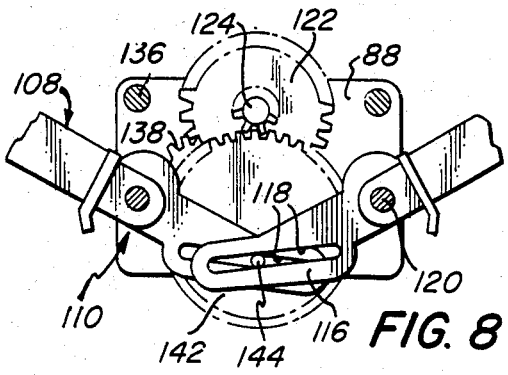
FIG. 8
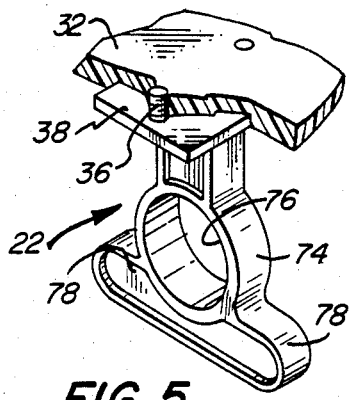
FIG. 5

GLOVE PUPPET FIGURE ASSEMBLY WITH ARTICULATED HEAD COMPONENTS

BACKGROUND OF THE INVENTION

Toys capable of animation have long found widespread appeal among children, and are disclosed in numerous forms in the prior art. One form of such action toys simulates a creature having wings that are movable in a flapping action, as disclosed in the following U.S. Pat. Nos. 2,036,328 to Furey; 2,637,939 to Polk; 3,153,871 to Semba; 3,577,670 to Gutierrez; 4,244,138 to Holahan et al; and 4,307,533 to Sims et al.

More particularly, the Furey patent describes a toy insect having movable wings that are operatively connected to a pair of ground-engaging wheels A flapping wing toy, constructed to simulate a bird or butterfly, is shown in the Polk patent; it employs a pair of hinged arms, oscillated by finger pressure, to which the wing sections are attached Semba shows the use of an electric motor to animate various parts of a bird toy, including the wings; projections on a rotated disc successively engage a rod to which the wings are attached, oscillating the rod and thereby causing a fluttering effect of the wings.

Gutierrez discloses a wing flapping toy in which the wings are loosely mounted upon a handle, and are held in place by a rubber band. The handle has a spring-like portion which terminates in a pair of parallel ears, disposed to force the wings to elevated positions when the handle is squeezed.

The Holahan et al patent describes an animated bird toy in which a trigger-like lever, pivotably mounted upon the body, is operated to simulate flapping of outwardly extending portions of the wings.

In the toy insect of the Sims et al patent, four wings are rotatably mounted upon pins attached to hinged mounting plates. The plates are acted upon by a lever to elevate the wings against the force of gravity.

Animated toys have of course taken many other forms, with parts other than wings that are movable. Like the winged toys described above, they may be animated either manually (e.g., by finger movement, as in hand puppet toys, by pull strings, etc.) or by drive means (e.g., electric or spring-powered motors), and in some instances they may be capable of producing sounds as well. Exemplary of such prior art are the following United States patents:

Fisher describes, in U.S. Pat. No. 928,744, figure toys having illuminating means for the eyes, mouth and nostrils, and containing a button-operated mechanism for opening the mouth.

A toy in the form of an animal is described by Price in U.S. Pat. No. 1,782,477, wherein a spring-powered motor is provided to produce a walking action as well as movement of head components.

A toy figure having movable parts, animated by a spring motor, is shown in the patent to Hyde, U.S. Pat. No. 2,158,860.

A snake-like toy in the form or a plurality of segments is taught in U.S. Pat. No. 2,241,576 by Barton, wherein strings can be pulled to move the toy in various directions.

In U.S. Pat. No. 2,614,365 Musselwhite et al disclose a doll having arms that are moved by push-button actuation.

Katz et al U.S. Pat. No. 3,358,400 provides a doll having pendulum-controlled eyes moved by a mechanism having cooperating cam and cam follower means Harp discloses a puppet in U.S. Pat. No. 3,698,127, which has a movable mouth operated by a pull string.

A head for a doll having lips which are movable to simulate talking is shown in Giroud U.S. Pat. No. 3,828,469; the mechanism used includes a wheel having eccentric studs, which is driven by a motor to impart a reciprocating displacement to the lips.

The patent to Akiyama U.S. Pat. No. 4,207,704, teaches a sound-producing animal-simulating toy in which a tape recorder can be employed to product voice or other sound.

A toy game, in the form of a simulated alligator body, is taught in the Cooper patent U.S. Pat. No. 4,324,065, wherein a leg of the alligator is tied to a latch for operating the upper jaws.

Hand and finger operated puppets or puppet-like toys are disclosed by Kilpatrick in U.S. Pat. No. 683,857; Reich in U.S. Pat. No. 1,417,860; Slocum U.S. Pat. No. 1,432,628; Edwards U.S. Pat. No. 1,518,576; Dallas U.S. Pat. No. 1,865,305; Renshaw U.S. Pat. No. 2,302,349; Werbe U.S. Pat. No. 2,756,448; and Chamberlain U.S. Pat. No. 3,918,180. Hodes U.S. Pat. No. 2,725,670 provides a manipulative animated toy in the form of a mouse in a cage, the mouse being articulated by finger movement. A hand puppet having legs and a head that can be moved by finger manipulation is taught in the patent to Rushton, U.S. Pat. No. 3,942,283. Baiera describes a puppet in the form of a walking or crawling creature, in U.S. Pat. No. 4,304,065; the body consists of a non-functional glove, and appendages into which the fingers of the operator are inserted for manipulation to simulate the walking action.

It is of course desirable to achieve optimal visual appeal, functional effectiveness, and durability in any such toy, while minimizing the complexity of the animating mechanism and the cost of manufacture. Despite the level of prior art activity indicated above, a demand remains for toys of unique construction, in which the foregoing criteria are realized.

Accordingly, a broad object of the present invention is to provide a novel glove puppet figure having articulated head components attached to a body, which components can be moved by finger manipulation while the body is held stationary on the operator's hand.

A more specific object of the invention is to provide such a puppet figure on which a unique gripping ring holder is employed, which not only permits articulation of the head component(s) while the body is held stationary, but also permits movement of the remaining fingers, such as to simulate walking or crawling legs of the puppet figure.

Another object of the invention is to provide a puppet figure having the foregoing features, in combination with a glove member which is constructed to serve both aesthetic and also functional purposes.

An additional broad object of the invention is to provide a novel glove puppet figure having mechanically driven flappable wings, in which the operating mechanism is of relatively uncomplicated and durable construction.

It is also an object of the invention to provide such a puppet figure which is relatively economical to manufacture, and in which the parts employed are relatively simple and few in number.

SUMMARY OF THE INVENTION

It has now been found that certain of the foregoing and related objects of the invention are attained by the provision of an assembly comprised of a puppet figure including a body portion and a head portion, the head portion comprising at least one component that is movable relative to the body portion. A glove member, adapted to receive the hand of the operator, has a portion attached to the body portion of the puppet figure, and at least one independently movable finger portion operatively connected to the "one" component of the head portion. Holding means provided on the body portion serves to prevent substantial movement relative to the hand of the operator, so that the "one" component can be articulated by finger-actuated movement of the finger portion of the glove member while the body portion is maintained, by the holding means, substantially stationary on the operator's hand.

Generally, a back portion of the glove member will be attached to the underside of the body portion of the figure. The "one" movable component of the head portion may be a lower jaw defining the mouth of the figure, or the head portion may be separate from the body portion and pivotably mounted thereon, to provide the one component. In the former case, the head portion may comprise a skull component pivotably mounted on the body portion for movement between a normally lowered position and a raised position, and having an upper jaw element thereon. The lower jaw component will in turn be pivotably mounted on the skull component for movement between a normally lowered position, away from the upper jaw element, and a raised position in contact therewith; the lower jaw component will provide the "one" component, and will effect elevation of the skull component by contact with the upper jaw element thereof.

In the preferred embodiments, the holding means will comprise a rigid gripping piece extending from the body portion and adapted to be gripped by the hand of the operator inserted into the glove member. Most desirably, the gripping piece will have a central ring element, and flange elements extending outwardly from opposite sides thereof and spaced from the body portion. The finger portion of the glove member will extend through the ring element of the gripping piece, with the flange elements being disposed for gripping by the operator's fingers on either side and outwardly of the ring element.

The glove member will desirably have four additional, independently movable finger portions defined on it, each constructed to resemble a leg on the body portion. This will enable the operator to simulate walking or crawling of the figure, by movement of his fingers within the "additional" finger portions, while simultaneously articulating the "one" component of the head portion with his remaining finger. Generally, the one finger portion will be for the operator's middle finge, and at least the "additional" finger portions of the glove member may be constructed to taper outwardly to a relatively pointed tip.

In especially preferred embodiments, the body portion of the figure will include means for supporting wing members for simulated flapping movement. More particularly, such supporting means may comprise a frame, a cam gear, a pair of substantially mirror image cam follower pieces, and drive means operatively connected for driving the cam gear. The cam gear used will have a gear portion and a centrally disposed axial shaft portion rotatably mounting the cam gear on the frame, and a drive pin projecting axially from the gear portion in eccentric relationship to its shaft portion. Each of the cam follower pieces will have an outer end portion adapted to support a wing member, and an inner end portion with a slot therein dimensioned to slidingly engage the drive pin of the cam gear. The follower pieces are mounted on the frame, to opposite sides of the cam gear shaft portion, for pivoting about axes parallel thereto and between the inner and outer end portions of the follower pieces, the inner end portions being disposed in overlapped relationship with the pin slidingly engaged within the slots thereof. Consequently, rotation of the cam gear by the driving means will cause the eccentric drive pin to slide in the slots of both of the cam follower pieces, simultaneously reciprocating the outer end portions thereof between raised and lowered positions, to simulate flapping of wing members supported thereon. Preferably, the inner and outer end portions of each of the follower pieces will be elongated and disposed in a substantially obtuse-angular relationship to one another, and the slot of the inner end portion will normally be substantially rectilinear; the drive means will advantageously be an electric motor.

Other objects of the invention are attained by the provision of a puppet figure assembly in the form of a toy creature with movable wings capable of simulating a flapping action. Such an assembly will include, in addition to features described hereinabove, first and second pairs of wing members extending outwardly from the body portion in generally opposite directions. The first wing members will be movable, and each of the second wing members will be generally aligned with one of the first wing members, preferably for contact thereby so as to produce audible sound.

In an assembly of this sort, at least the major part of each of the wing members will normally be of generally planar configuration; usually, the mutually aligned members will be disposed in generally parallel planes, the second wing members will be stationary on the body, and the reciprocating means will comprise drive means operatively connected to the first wing members. More specifically, the reciprocating means may comprise an electric motor, and the assembly will desirably include means for pivotably mounting the first wing members, with connecting means being provided for converting rotary movement of the motor shaft to reciprocating pivotal movement of the mounting means, and for transmitting power from the motor thereto.

BRIEF DESCRIPTION OF THE DRAWINGS

FIG. 5 is a perspective view of the gripping ring holder used for hand support of the puppet figure, also showing a small section of the body to which the holder is attached;

FIG. 6 is a fragmentary plan view depicting the driving mechanism for the movable wings of the puppet figure, also showing the section of the body in which it is supported;

FIG. 7 is a front elevational view of the mechanism of FIG. 6, with the power transmitting components thereof shown in their lowered wing position;

FIG. 8 is a view similar to FIG. 7 showing the transmission components in their elevated wing position;

FIG. 9 is a perspective view of the coupling member utilized to connect the wing members to the supporting pieces provided on the body of the puppet figure; and FIG. 10 is a plan view of the coupling member of FIG. 9, with the wing member in place and mounted upon the end portion of the supporting piece, showing normal and deflected positions in full and phantom line respectively

DETAILED DESCRIPTION OF THE ILLUSTRATED EMBODIMENTS

Figure 1:
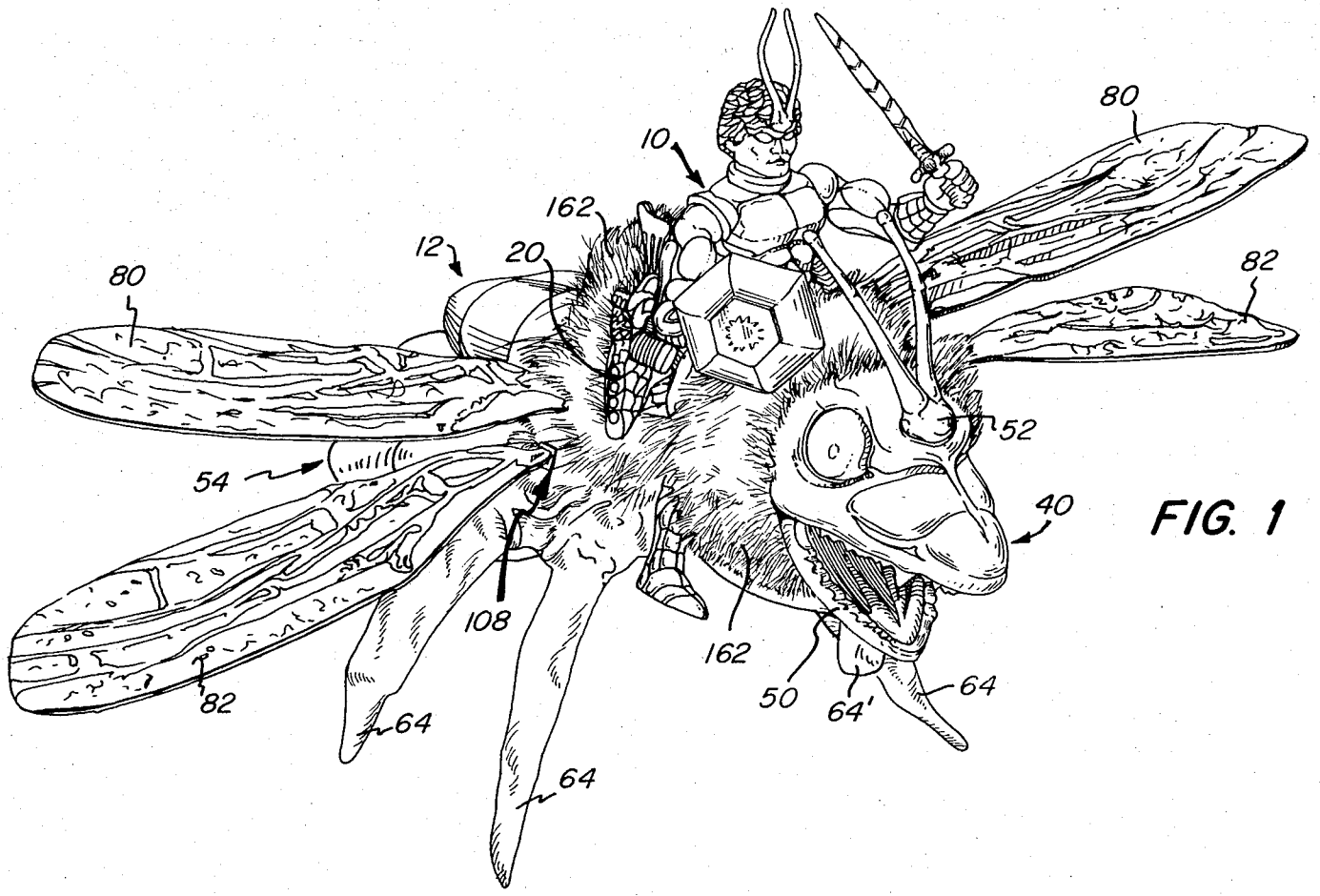
FIG. 1 is a perspective view of a glove puppet figure embodying the present invention, having a humanoid figure seated thereupon.

Although the puppet figure of the invention may take diverse forms, a science-fiction motif is currently regarded to be among the most desirable. Accordingly, FIG. 1 depicts the puppet figure as a winged creature, in combination with a humanoid figure, generally designated by the numeral 10; the humanoid figure is included only for the purpose of better illustrating the thematic concept, and itself constitutes no part of the present invention.

Details of construction of the puppet figure are shown in FIGS. 2–5, from which it can be seen to have a body consisting of an upper section, generally designated by the numeral 12, and a lower section, generally designated by the numeral 14. At the forward end of the body are provided a pivot mount, generally designated by the numeral 16 and interposed between the two sections 12, 14, upstanding cooperating saddle pieces 18, 20, and an underlying gripping ring member, generally designated by the numeral 22. The saddle pieces 18, 20 have depending post portions 24 thereon, which pass through the apertures 28 in the forward part 30 of the upper body section 12, and thereafter through the passages 26 in the pivot mount 16, into the recesses of the upstanding cylindrical bushing elements 34 formed on the base portion 38 of the gripping ring member 22. The elements 34 project through the openings 28 in the forward part 32 of the lower body section 14, and the entire assembly is secured by screws 36, which are inserted through the base portion 38 and are engaged in the ends of the post portions 24. Additional screws (not shown) are employed at appropriate locations to hold the more rearward parts of the body sections together.

A skull component, generally designated by the numeral 40, pivotably attaches the head of the figure to the forward end 19 of the pivot mount 16, which is formed with a laterally extending axle element 42 for that purpose. A pair of laterally spaced, upstanding rib elements 44 are formed along the rear of the skull component 40 (only one of which is visible), the lower ends of which are provided with upwardly extending notches 46, to seat the ends of the axle 42 and thereby permit pivoting of the head portion thereabout. A tang (not visible) on the back of the skull component 40 engages within the slot 48 formed through the forward portion 19 of the mount 16, to secure the assembly and to limit the arc of pivoting of the head component.

A lower jaw component 50 is pivotably mounted within the skull component 40, for which purpose stub axle elements 52 project laterally from each side into small circular recesses (not shown) formed on the interior of the skull component. As will be appreciated, and as is shown by the full-line representation of FIG. 3, both the skull component 40 and the lower jaw component 50 are freely pivotable, to assume lowered and open-mouth positions, respectively, under the force of gravity. For appearance purposes, an antenna-like piece 53 is affixed through a forehead section of the skull component.

Figure 4:
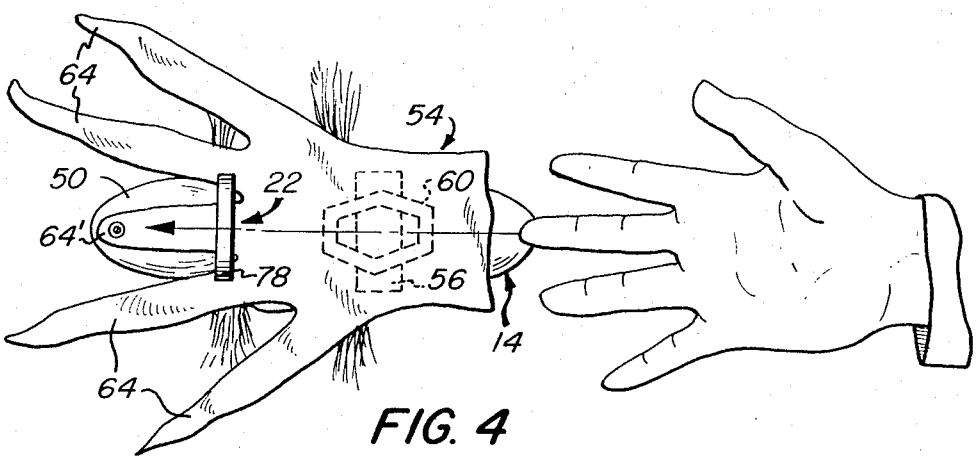
FIG. 4 is a bottom view of the puppet figure of FIG. 1, drawn to a reduced scale and showing the hand of an operator positioned for insertion into the glove member thereof.
Figure 3:
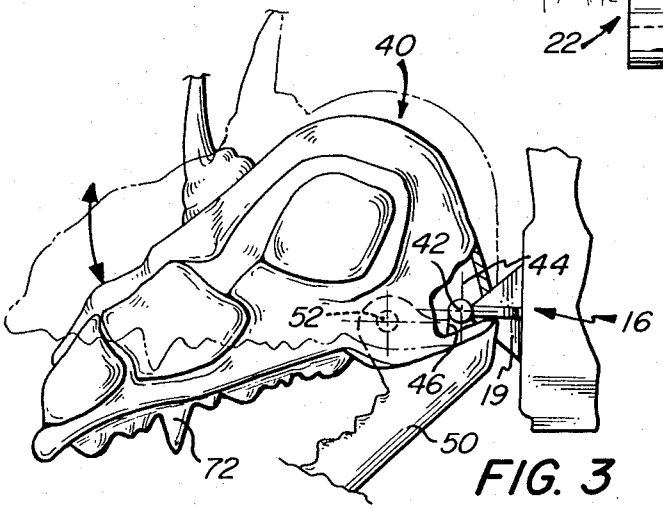
FIG. 3 is a fragmentary elevational view of the head and most forward portion of the body of the puppet figure, showing in full and phantom line, respectively, the lowered and elevated positions of the skull component of the head.

Turning now in greater detail to FIG. 4, a glove member, generally designated by the numeral 54, is secured to the lower body section 14 of the puppet figure. It has a band or loop 56 affixed on its back portion 58, which is clamped in place by a substantially hexagonal retainer 60 seated within the correspondingly shaped recess 61 formed in the underside of the lower section 14, and affixed by screws 62 thereto. The glove member has five finger portions 64, the tip of the middle one 64′ being attached to the articulated lower jaw component 50 by a small plate 66, which is received within a corresponding recess 68 and held in place by a screw 70. In this manner, the finger of the operator can be used to pivot the lower jaw component 50, with or without pivoting skull component 40. Thus, the lower jaw 50 can be moved upwardly and downwardly with respect to the skull component, and the latter can be elevated from its normal position by closing the lower jaw component 50 against the upper jaw element 72 defined therein, and raising them together from the position of initial contact.

The gripping ring member 22 is constructed both to accommodate the middle finger 64′ of the glove member 54, and also to enable the operator hold the body of the puppet figure substantially immobile. As best seen in FIG. 5, the gripping member 22 has a ring portion 74, with an opening 76 through which the finger portion 64′ is inserted, at the bottom of which are formed laterally extending ears or flange elements 78. As a result, with his hand inserted into the glove member 54 and his middle finger extended through the ring portion 74, the operator's adjacent fingers can be positioned along the outside of the ring portion 74 and curled over the flange elements 78, thereby enabling him to securely grasp the gripping member.

All of the fingers 64 of the glove member 54 are constructed with a tapered generally pointed configuration, giving the appearance of insect-like legs. As is suggested in FIG. 1, the fingers of the operator can be moved to "walk" the puppet across a surface, or simply to simulate lifelike activity. Because of the unique design of the gripping ring, movement of the legs (as well as of the component(s) of the head) can be achieved while the body of the creature is held in a stable position relative to the hand.

As is also best seen in FIG. 1, the puppet figure has four wings, two of which are stationary and the other two being capable of simulated flapping movement. The supporting means and mechanism for mounting and operating the wings are most fully illustrated in FIGS. 6–10.

More specifically, the drive mechanism consists of an electric motor 84 and a transmission assembly disposed within a gear cage, generally designated by the numeral 86 and disposed forwardly thereof. The motor 84 is mounted between the plate 88 of a rear housing piece and an end cap 90, the latter being spaced by a pair of post portions 92 integrally formed on the plate 88 and held in place by suitable fasteners 94. Power for the motor is supplied by a pair of standard dry cell batteries 96, which are retained within the compartment 97 of a battery box structure 98, formed into the lower body section 14 and closed by the hinged door 160, the latter having small lugs (not seen) to lock it in place over the compartment. The batteries 96 are electrically connected to a contact plate 102 by the coil springs 100, in conventional fashion, and suitable leads 104 connect the contact plate to the motor coil through a slide switch 106.

The wings 80 are supported by socket-like coupling pieces, generally designated by the numeral 108 (to be more fully described hereinbelow), which are in turn mounted upon mirror image cam follower pieces, generally designated by the numeral 110. As best seen in FIGS. 7 and 8, each of the cam follower pieces 110 consists of an outer end portion 112 having an enlarged tip 114 thereon, and an angularly offset inner end portion 116, the latter having an elongated, rectilinear slot 118 formed through it and extending at a relatively large obtuse included angle to the primary axis of the part. Each of the follower pieces 110 has a transverse bore 119 intermediate its outer and inner end portions 112, 116, by which it is pivotably mounted upon a shaft element 120, integrally formed on and projecting forwardly from the plate 88 of the rearward housing piece.

Also assembled within the gear cage 86 is a compound gear consisting of a relatively large element 122 and a relatively small element 124, mounted on a centrally disposed shaft 126. The shaft is journaled between bosses 128, 130, which project from the rearward and forward plates 88, 132, respectively, the plates in turn being spaced from one another by post portions 136 projecting from the plate 88, and secured by fasteners 134. The large component 122 of the compound gear is in meshing engagement with the pinion 138 on the motor shaft 140, and the smaller component 124 is in meshing engagement with a cam gear 142. The latter has a short eccentric drive pin 144 projecting forwardly from one of its faces, which is received in both of the slots 118 of the overlapping inner end portions 116 of the cam follower pieces 110.

Energization of the motor 84 by proper positioning of the switch 106 will effect rotation of the cam gear 142 through the pinion 138 and the compound gear (122/124), causing the eccentric pin 144 to slide within the slots 118, in turn pivoting the follower pieces 110 simultaneously about the shaft elements 120. With the cam gear and follower pieces in the relationship shown in FIG. 7, the wings 80 will be in their fully lowered positions; rotating the cam gear 142 through half a cycle, to the position shown in FIG. 8, will pivot the pieces 110 to an upward orientation, thereby elevating the attached wings. As will be appreciated, continuous rotation of the cam gear 142 will reciprocate the wings 80 between their raised and lowered positions, and will thereby simulate a flapping motion.

Stationary wing members 82 are mounted upon an elongated support piece 150 which extends across the lower section 14 of the body and is fastened thereto by small screws 152. The free ends of the supporting piece are constructed with the same configuration as the outer ends of the follower pieces 110, for insertion into the couplers 108. The outer end portions 112 of both the supporting bracket piece 150 and also of the follower pieces 110 extend, respectively, through openings 154, 156, formed through the upper and lower body sections 12, 14; a small slot 158 is also formed in the upper section 12 to permit access to the slide switch 106.

The couplers 108 for the wing members 80, 82 take the form of rubber sockets having axially aligned recesses 146, 148 extending inwardly from their opposite ends, the couplers being sufficiently flexible to enable resilient deflection of the mounted wing (along the longitudinal axis of the body), as indicated by the phantom line representations of FIG. 10. The recess 146 is dimensioned and configured to receive the outer end portion 112 of either a cam follower piece 110 or the supporting bar 150, as the case may be, and has an enlarged inner portion (unnumbered) dimensioned and configured to engage the tip 114 thereon. This construction enables facile connection and disconnection of the wings, such as for transport and storage.

The oppositely extending recess 148 is dimensioned and configured to receive the inner end portion 81 of a wing member 80, 82, which has a pleated configuration, such as may be produced by laterally compressing the flat wing; this not only facilitates insertion into the recess 148, but also rigidifies the wing member at the point of connection. The cross section of the recess 148 is of course configured to accommodate the end portion 81, and is formed with small, longitudinally extending internal ribs to enhance the level of frictional contact thereupon.

Figure 2:
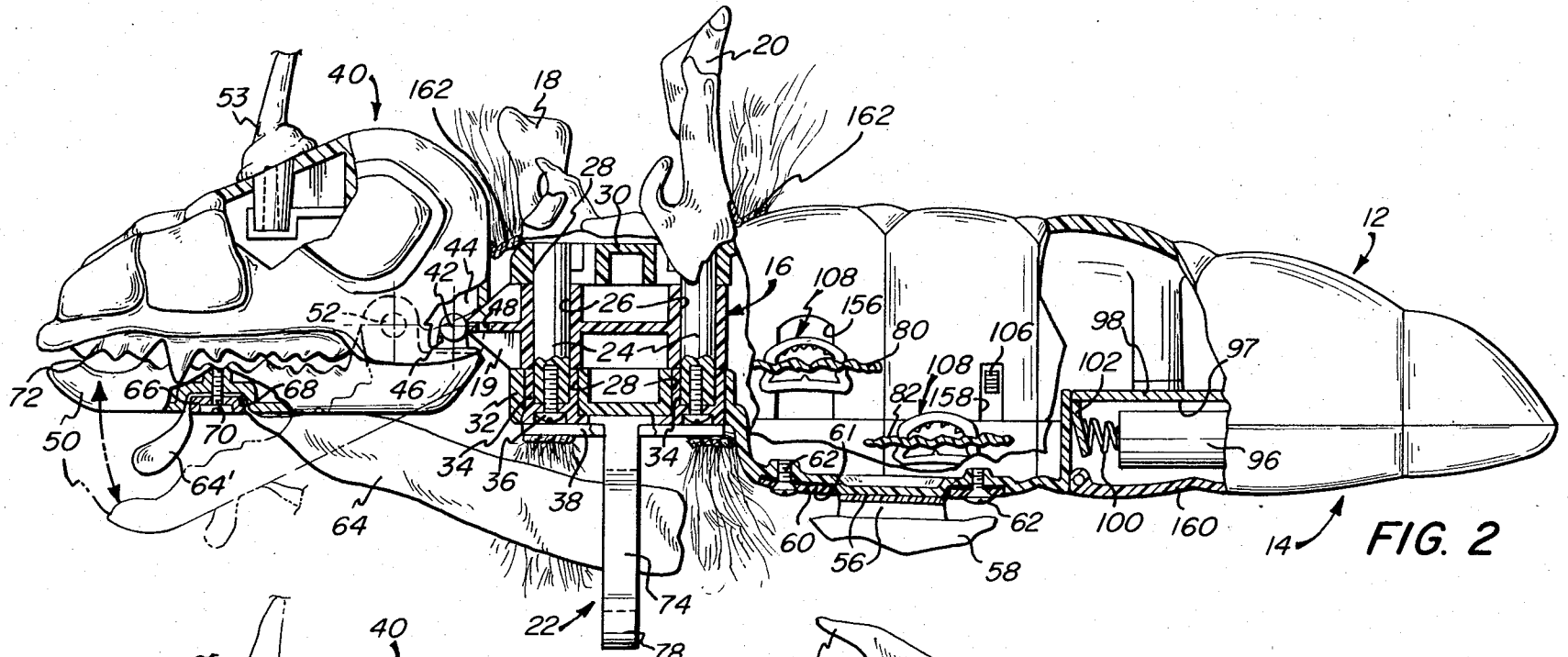
FIG. 2 is a fragmentary elevational view of the puppet figure of FIG. 1, drawn in partial section and to an enlarged scale, and showing in full and phantom line, respectively, the closed and opened positions of the lower jaw component of the head.

As can be seen in FIGS. 1, 2, and 6, the movable wings 80 are disposed above (or posteriorly) and slightly forwardly of the stationary wings 82. However, the longitudinal offset and the anterior-posterior (top to bottom) spacing of the pairs of wings on each side of the body are such that they not only overlap, but that they in fact contact one another, over a substantial area, when the upper wings are actuated. Such contact produces an audible sound, similar to a loud flapping noise, the effect of which can be quite pronounced and therefore a source of considerable pleasure for a child playing with the puppet figure.

Finally, tufted or plush collars 162 are positioned on the body of the puppet figure in the area between the forward and rearward parts of the body, and at the point between the body portion and the head. Not only do these collars inherently contribute to the aesthetics of the figure, but they also improve its appearance by obscuring areas that look mechanical, and therefore undesirable in a toy of this nature.

Although various materials of construction can be employed for the several parts of the puppet figure, as will be evident to those skilled in the art, the body and head portions, as well as many parts of the drive mechanism, will desirably be fabricated from suitable plastics. The wings will also normally be made from a synthetic resinous material, which may be in the form of a laminated sheet of acetate or vinyl plastic (typically about ten mils thick), desirably preferably constructed or treated to provide an iridescent or similar optical effect, and patterned with vein-like surface contours. A material particularly preferred for use in fabricating the wing members is the polyvinyl chloride laminate commercially available from the Coburn Corporation, of Lakewood, N.J. under the trade designation DIFRACTOLIGHT. As indicated above, the glove will desirably be fabricated, in whole or in part, from a fabric having elastic properties, such as spandex. As is also indicated above, the drive means for the wing-actuating mechanism may be other than an electric motor; for example, a spring-powered motor may be substituted if so desired.

Thus, it can be seen that the present invention provides a novel glove puppet figure having articulated head components attached to a body, which components can be moved by finger manipulation while the body is held stationary on the operator's hand. A unique gripping ring holder is provided, which not only permits articulation of the head component(s) while the body is held stationary, but permits movement of the remaining fingers as well, such as to simulate walking or crawling legs of the puppet figure, and the glove member used may be constructed to serve both aesthetic and also functional purposes. In addition, the novel glove puppet figure provided may have mechanically driven flappable wings, for which the operating mechanism is of relatively uncomplicated and durable construction, and movement of the winds may be effective to produce an audible sound.

Finally, the invention provides such a puppet figure which is relatively economical to manufacture, and in which the parts employed are relatively simple and few in number.

Having thus described the invention, what is claimed is:

1. A glove puppet figure assembly comprised of:

a puppet figure including a body portion and a head portion, said head portion comprising at least one component that is movable relative to said body portion;

a glove member separate from said figure and adapted to receive the hand of the operator, said glove member having a portion attached to said body portion of said puppet figure, and having at least one finger portion defined therein movable independently of the remainder of said glove member and operatively connected to said one component of said head portion; and rigid holding means on said body portion, separate from said glove member, for preveing substantial movement relative to the hand of the operator, whereyb said one component can be articulated by finger-actuated movement of said finger portion of said glove member, while said body portion is maintained by said holding means substantially stationary on the operator's hand.

2. The assembly of claim 1 wherein said attached portion is a back portion of said glove member and is attached to the underside of said body portion of said figure.

3. The assembly of claim 1 wherein said one component is a lower jaw defining the mouth of said figure.

4. The assembly of claim 1 wherein said head portion is separate from said body portion and is pivotably mounted thereon, said head portion providing said one component.

5. The assembly of claim 1 wherein said head portion comprises a skull component pivotably mounted on said body portion for movement between a normally lowered position and a raised position and having an upper jaw element thereon, and a lower jaw component pivotably mounted on said skull component for movement between a normally lowered position away from said upper jaw element and a raised position in contact therewith, said lower jaw component providing said one component and effecting elevation of said skull component by contact with said upper jaw element thereof.

6. A glove puppet figure assembly comprised of:

a puppet figure including a body portion and a head portion, said head portion comprising at least one component that is movable relative to said body portion;

a glove member separate from said figure and adapted to receive the hand of the operator, said glove member having a portion attached to said body portion of said puppet figure, and having at least one independently movable finger portion defined therein and operatively connected to said one component of said head portion; and a rigid gripping piece extending from said body portion and adapted to be gripped by the hand of the operator inserted into said glove member for preventing substantial movement relative to the hand of the operator, said gripping piece having a central ring element and flange elements extending outwardly from opposite sides thereof and spaced from said body portion, said finger portion of said glove member extending through said ring element of said gripping piece, and said flange elements being disposed for gripping by the operator's fingers on either side and outwardly of said ring element, whereby said one component can be articulated by finger-actuated movement of said finger portion of said glove member, while said body portion is maintained by said holding means substantially stationary on the operator's head.

7. The assembly of claim 1 wherein said glove member has defined thereon four additional independently movable finger portions, each constructed to resemble a leg on said body portion, so that the operator can simulate walking or crawling of said figure, by movement of his fingers within said additional finger portions, while simultaneously articulating said one component with his remaining finger.

8. The assembly of claim 7 wherein at least said additional finger portions of said glove member are constructed to taper outwardly to a relatively pointed tip, and wherein said one finger portion is for the operator's middle finger.

9. The assembly of claim 1 wherein said body portion includes means for supporting wing members for simulated flapping movement.

10. The assembly of claim 9 wherein said wing member supporting means comprises:

a frame;

a cam gear having a gear portion and a centrally disposed axial shaft portion rotatably mounting said cam gear on said frame, and having a drive pin projecting axially from said gear portion in eccentric relationship to said shaft portion;

a pair of substantially mirror-image cam follower pieces, each having an outer end portion adapted to support a wing member, and an inner end portion with a slot therein dimensioned to slidingly engage said drive pin, said follower pieces being mounted on said frame, to opposite sides of said cam gear shaft portion, for pivoting about axes parallel thereto and between the inner and outer end portions of said follower pieces, said inner end portions being disposed in overlapped relationship, with said pin slidingly engaged within said slots thereof; and drive means operatively connected for driving said cam gear, whereby rotation of said cam gear by said driving means will cause said drive pin to slide in said slots of both of said cam follower pieces, simultaneously reciprocating said outer end portions of said pieces between raised and lowered positions, to simulate flapping of wing members when supported thereon.

11. The assembly of claim 10 wherein said drive means comprises an electric motor.

12. The assembly of claim 10 wherein said inner and outer end portions of each of said follower pieces are elongated and are disposed in a substantially obtuse-angular relationship to one another.

13. The assembly of claim 12 wherein said slot of said inner end portion of said follower piece is substantially rectilinear.

14. A glove puppet figure assembly comprised of:

a puppet figure including a body portion and a head portion, said head portion comprising at least one component that is movable relative to said body portion;

a pair of first wing members;

means for movably mounting said first wing members on said body portion to extend outwardly thereof in generally opposite directions;

a pair of second wing members;

means for mounting said second wing members on said body portion with each of said second wing members extending outwardly from said body portion and in general alignment with one of said first wing members for contact thereby;

means on said body portion for reciprocating said first wing members thereabout in simulated flapping action and to effect substantial contact with said aligned second wing members, said wing members being so constructed that such contact therebetween will produce audible sound;

a glove member separate from said figure and adapted to receive the hand of the operator, said glove member having a portion attached to said body portion of said puppet figure, and having at least one independently movable finger portion defined therein movable independently of the remainder of said glove member and operatively connected to said one component of said head portion; and holding means on said body portion for preventing substantial movement relative to the hand of the operator, whereby said one component can be articulated by finger-actuated movement of said finger portion of said glove member, while said body portion is maintained by said holding means substantially stationary on the operator's hand.

15. The assembly of claim 14 wherein at least the major part of each of said wing members is of generally planar configuration, wherein said mutually aligned wing members are disposed in generally parallel planes, wherein said means for mounting said second wing members is substantially fixed on said body portion, and wherein said reciprocating means comprises drive means operatively connected to said first wing members.

16. The assembly of claim 14 wherein said reciprocating means comprises an electric motor, and wherein said mounting means for said first wing members is pivotable on said body portion, said assembly additionally including means for operatively connecting said motor to said first wing member mounting means, said connecting means comprising a mechanism for converting rotary movement of the shaft of said motor to reciprocating pivotal movement of said first wing member mounting means and for transmitting power from said motor thereto.

* * * * *